United States Patent [19]

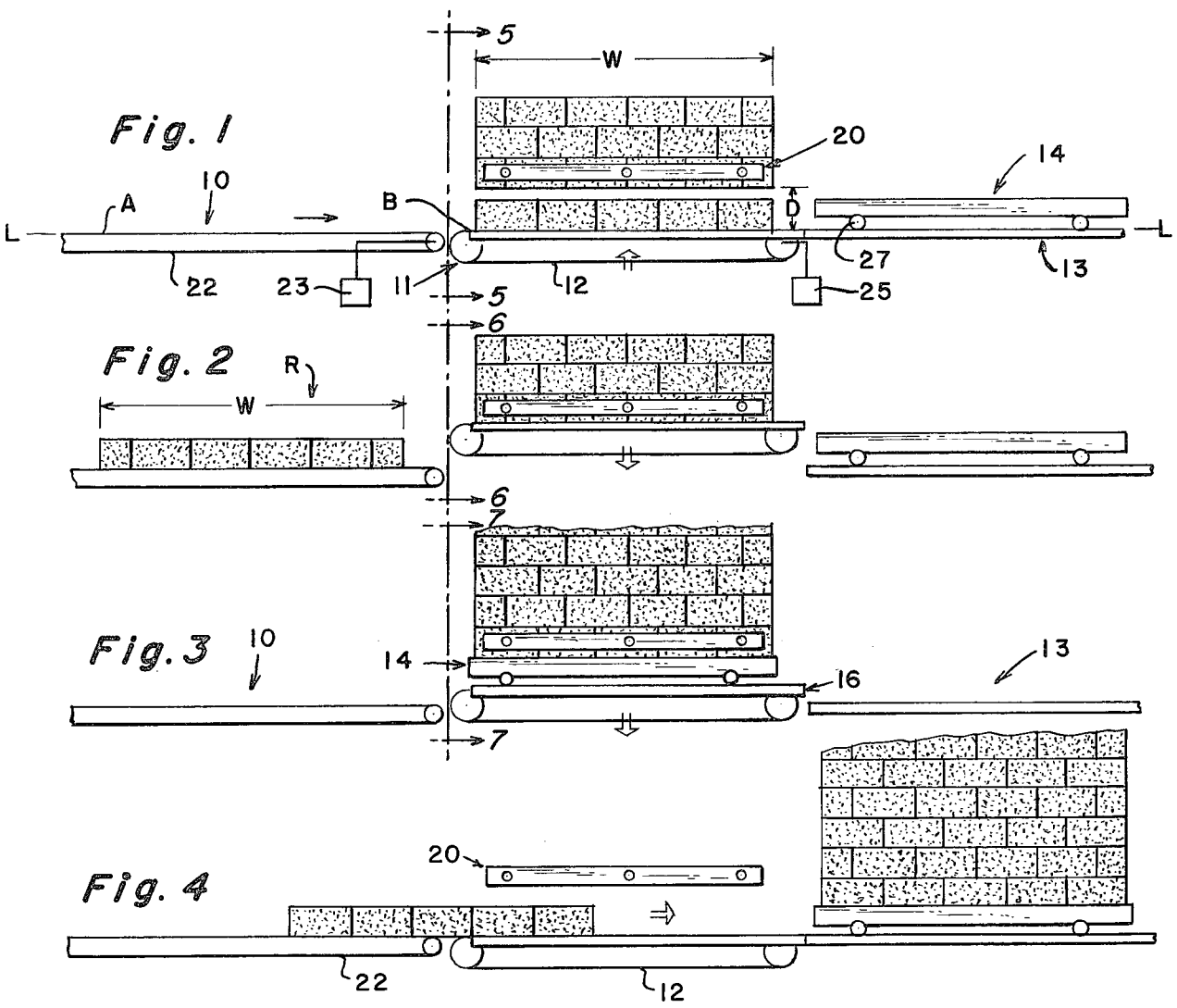
Fig. 1
Fig. 2
Fig. 3
Fig. 4
10
12
13
14
16
20
22
23
25
27
W
D
A
B
R
L
5
6
7
11
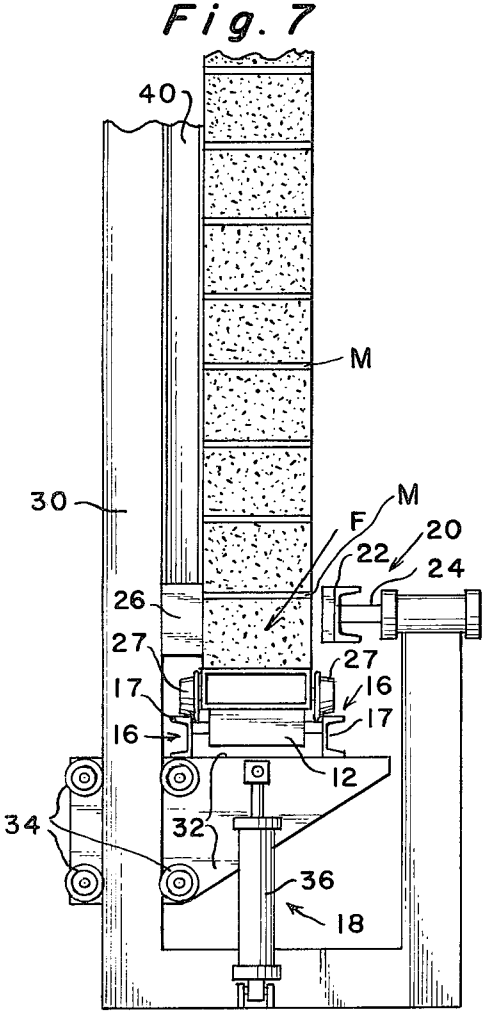
Fig. 7
M
F
20
24
22
27
16
17
12
18
36
32
34
30
26
40

Lingl, Sr.

[11] 4,094,118

[45] June 13, 1978

[54] METHOD AND APPARATUS FOR FEEDING OF ROWS OF BLOCKS

[75] Inventor: Hans Lingl, Sr., Neu-Ulm, Ludwigsfeld, Germany

[73] Assignee: Lingl Corporation, Paris, Tenn.

[21] Appl. No.: 731,095

[22] Filed: Oct. 8, 1976

[51] Int. Cl.[2] ..... E04G 21/22; E04D 1/35

[52] U.S. Cl. ..... 52/747; 52/749; 214/6 A; 214/6 BA

[58] Field of Search ..... 52/747, 749; 214/6 A, 214/6 BA, 6 P; 156/297, 559

[56] References Cited

U.S. PATENT DOCUMENTS

| | | | |
|---|---|---|---|
| 1,292,636 | 1/1919 | Parker | 214/6 BA |
| 3,350,833 | 11/1967 | Larger | 52/749 |
| 3,585,092 | 6/1971 | Storer | 52/749 |
| 3,705,657 | 12/1972 | Arnemann | 214/6 BA |
| 3,790,428 | 2/1974 | Lingl | 156/559 |
| 3,834,973 | 9/1974 | Kummerow | 156/558 |
| 3,933,570 | 1/1976 | Wright | 156/558 |
| 3,986,620 | 10/1976 | Wilde et al. | 214/6 P |

FOREIGN PATENT DOCUMENTS

| | | | |
|---|---|---|---|
| 2,253,816 | 8/1974 | Germany | 52/749 |
| 2,432,146 | 1/1976 | Germany | 214/6 P |
| 2,048,944 | 2/1976 | Germany | 52/749 |
| 185,579 | 10/1963 | Sweden | 214/6 BA |
| 442,145 | 1/1968 | Switzerland | 214/6 P |

*Primary Examiner*—Leslie Brown

*Attorney, Agent, or Firm*—Cushman, Darby & Cushman

[57] ABSTRACT

A method and apparatus for the fabrication of a vertical block wall section. A vertical wall section is formed by conveying a row of blocks from a first conveyor belt to a second conveyor belt, elevating the row of blocks on the second conveyor belt until it is in contact with a wall section held vertically above the second conveyor belt, and holding the wall section with the additional row in elevated position while the second conveyor belt is lowered to receive a further row. After formation of a wall section of a given predetermined height, a wheeled pallet is moved onto a track on the second conveyor belt to a position below the elevated wall section. The pallet is then elevated by the second conveyor belt into engagement with the elevated wall section, the hold for the wall section is released, the pallet is lowered to an original position, and the wall section disposed on the pallet is moved to a position vertically displaced from the second conveyor means. In this way, vertical wall sections may be fabricated without interruption of the fabricating sequence by waiting for individual blocks to be asembled into a block row, and without waiting for themortar to set before removing the preformed wall section, and by minimizing the amount of chipping damage resulting to the block edges.

10 Claims, 7 Drawing Figures

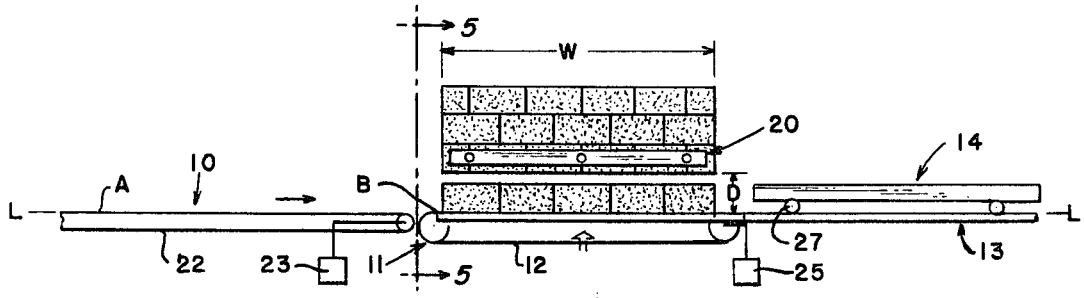

METHOD AND APPARATUS FOR FEEDING OF ROWS OF BLOCKS

BACKGROUND AND SUMMARY OF THE INVENTION

The invention relates to a method and apparatus for the fabrication of vertical wall sections. There are numerous prior art systems for the fabrication of wall sections, such as described in U.S. Pat. No. 3,585,092 and 3,834,973, however, such prior art procedures have various disadvantages which limit the capacity thereof, and which can result in damage to blocks being utilized for the formation of the wall sections. For instance, the apparatus shown in U.S. Pat No. 3,585,092 is limited in capacity since individual blocks are fed one at a time from a fixed table to a vertically movable support bed, and it is necessary to wait until the mortar holding rows of blocks together has set sufficiently before the preformed wall section can be removed from the bed support (as by lifting the wall section by reinforcing rods with a crane). Also, since the individual blocks are pushed from the fixed table on to the movable supporting bed, there is a possibility that the edges of the blocks can be damaged on the edges of the fixed table or supporting bed, and various adverse consequences can flow from the chipped edges.

According to the method and apparatus of the present invention, the capacity of an individual wall fabricating unit can be significantly increased since individual feeding of blocks to an elevating member is eliminated and since there is no reason to wait until the mortar has set sufficiently before moving the panel from the prefabricating apparatus once the panel is completed. Additionally, the chances of blocks being chipped during prefabrication are greatly minimized. According to key features of the present invention a preformed row of blocks is movable from a first belt onto a second conveyor belt, no edges upon which the blocks might be chipping provided by the conveyor belts, and all of the blocks of the row being preassembled before being fed from the first conveyor belt to the second conveyor belt so that there is no necessity for waiting for individual blocks to be added to the row during assembly of the wall panel. Additionally, a wheeled pallet is disposed on the opposite of the second conveyor means from the first conveyor means, the wheeled pallet being movable on a track onto the second conveyor belt system so that it may be disposed under an elevated, preformed wall section. The wheeled pallet may then be moved into contact with the preformed wall section immediately after the bottom row of the wall section has been formed, the pallet lowered back to an original position, and the preformed wall section on the pallet horizontally transported away from the prefabricating apparatus to a subsequent treating system. Since the wall section may be removed from the prefabricating apparatus immediately after the bottom row of the wall section is disposed in place, there is no significant delay occasioned by the removing step as is necessary in the prior art.

The apparatus according to the present invention includes a first conveyor belt system having an upper transporting surface thereof that is generally horizontal and at a horizontal level L, and at least W in length wherein W is the width of a vertical block wall section to be formed, a second conveyor belt system disposed as a continuation of the first conveyor belt system and having an upper transporting surface thereof that is generally horizontal and is normally disposed at the horizontal level L, and is at least W in length, and a third conveying system. The third conveying system is disposed as a continuation of the second coveyor belt system and includes a track that is generally horizontal and disposed at the horizontal level L. A wheeled pallet is diposed on the track and movable with respect thereto, the pallet being at least W in length. Track means are formed with the second conveyor belt system including a track rail disposed on either side of the conveyor belt of the second conveyor belt system. When the pallet cooperates with the track means of the second conveyor belt system, the pallet is disposed above the upper transporting surface of the second conveyor belt. Means are provided for vertically moving the second conveyor belt system so that a row of blocks disposed thereon may be elevated at least a vertical distance great enough to allow the pallet to be disposed in cooperation with the track means of the second conveyor belt system, and beneath a row of blocks when the row of blocks is held in a vertical position to which it may be elevated, and means for selectively holding rows of blocks in an elevated position to which they are movable by said vertically moving means. The second conveyor belt system may include a vertically upstanding guide member, a mounting plate for mounting the second conveyor belt and the track means rails, guide means associated with the mounting plate for cooperation with the guide member to provide vertically guided movement of the second conveyor belt, and hydraulic ram means operatively connected to the mounting plate for raising and lowering thereof. The holding means may comprise a horizontally elongated clamp plate mounted at a fixed vertical position, a vertical distance above the normal position of the conveyor belt system at least as great as the height of the pallet, a plurality of horizontally extending hydraulic ram means mounting the clamping plate, and a stationary bearing ledge disposed at substantially the same vertical position as the clamping plate on the opposite side of the second conveyor belt from the clamping plate. A vertically upstanding block guide member may be disposed on the same side of the second conveyor as the bearing ledge, and will provide a substantially vertical continuation of the bearing ledge to prevent excessive horizontal movement of a multiple row vertical wall section.

According to the method of the present invention, a first row of blocks of width W (corresponding to the width of the vertical wall section to be formed) is transported from a first conveyor belt to a second conveyor belt, the second conveyor belt with the first row of bricks thereon is elevated a distance at least as great as the height of the blocks of a second row of blocks, the elevated first row of blocks is held in the position to which it has been elevated while the second conveyor belt is lowered to receive a second row of blocks, and the second row of blocks of width W is transported from the first conveyor belt to the second conveyor belt so that the first row is disposed immediately under the second row. The second row of blocks has mortar disposed on the upper surface thereof, and it is elevated by the second conveyor belt so that contact is made between the mortar on the top of the second row of blocks and the first row of blocks. The hold of the first row of blocks is released when contact is made with the mortar with the second row of blocks and the blocks are further elevated a distance at least as great as the height of the blocks of a third row of blocks. The elevated first and second row of blocks are held in their elevated position while the second conveyor belt is lowered to receive a third row of blocks and the above steps are repeated for third and subsequent rows of blocks until a vertical wall section of a desired predetermined height is formed. The vertical wall section is held in an elevated position at least as great as the height of a movable pallet, while the second conveyor belt is lowered out of contact with the blocks and the movable pallet is horizontally moved to a position directly under the vertical wall section. The pallet is then elevated until it is in contact with the wall section, the hold for the wall section is released, and the pallet is lowered to its original position with the wall section disposed thereon. The wall section is then transported on the pallet to a position horizontally removed from the second conveyor belt system. As previously mentioned, the wall section can be transported away from the second conveyor belt system essentially immediately after the wall section is formed, there being no need to wait for the mortar to set completely, and the wall section is moved in a horizontal direction away from the first conveyor belt as it is transported away from the second conveyor belt system. Preferably the pallet is mounted on wheels and is movable on a track, the track including portions on the second conveyor so that the method step of horizontally moving the pallet to a position directly under the vertical wall section is accomplished by rolling the pallet on the track means over the second conveyor belt and beneath the wall section. Additionally, each row of blocks is transported from the first conveyor belt to the second conveyor belt as a unit, all the blocks of each row already mortared together while they are transported from the first conveyor belt to the second conveyor belt, therefore, there is no need to wait for each individual block to be pushed onto the second conveyor belt. A plurality of feeds can be provided of rows of blocks onto the first conveyor belt, or the rows may be formed completely on the first conveyor belt during the elevating steps of the method, such complete formation not being possible in the prior art as exemplified by U.S. Pat. No. 3,585,092.

It is the primary object of the present invention to provide an improved method and apparatus for the fabrication of vertical wall sections from blocks. This and other objects of the invention will become clear from an inspection of the detailed description of the invention, and from the appended claims.

BRIEF DESCRIPTION OF THE DRAWING

FIG. 1 is a schematic view of exemplary apparatus according to the present invention just after transport of a new row of bricks from the conveyor belt to the second conveyor belt;

FIGS. 2 through 4 are further showings of the exemplary apparatus of FIG. 1 during further method steps according to the present invention;

FIGS. 6 and 7 are side, detailed views taken along lines 6—6 of FIGS. 2 and 7—7 of FIG. 3 respectively similar to FIG. 5, only showing the apparatus in the position of the apparatus during method steps of FIGS. 2 and 3.

DETAILED DESCRIPTION OF THE INVENTION

Figure 6:
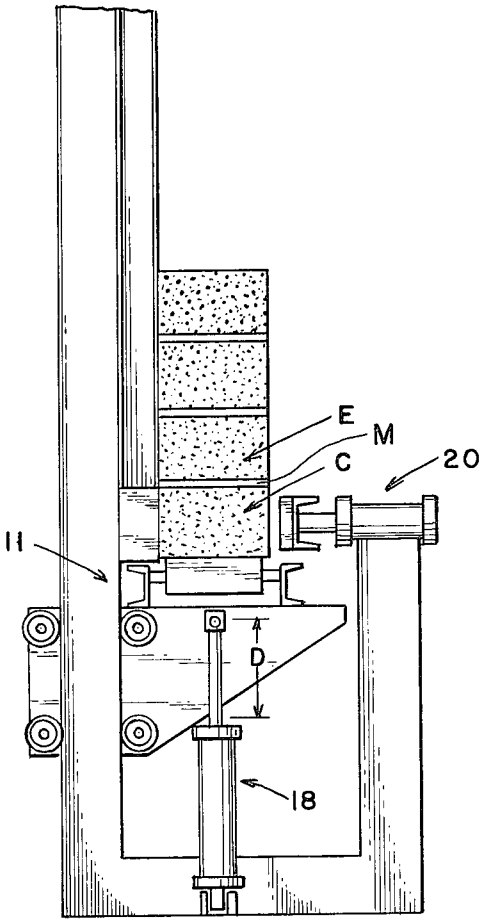

The apparatus according to the present invention generally includes a first conveyor belt system 10, a second conveyor belt system 11 including a conveyor belt 12, a third conveying system 13 including a track, a wheeled pallet 14 disposed on the track and movable with respect thereto, track means 16 formed with the second conveyor belt system 11, said track means including a track rail 17 disposed on either side of the conveyor belt 12, means 18 (see FIGS. 5–7) for vertically moving the second conveyor belt system 11 and means 20 for selectively holding rows of blocks in an elevated position to which they are movable by the vertical moving means 18.

The first conveyor belt system 10 includes a conveyor belt 22 having an upper transporting surface (A) thereof that is generally horizontal and at a horizontal level L. The upper transporting surface (A) is at least W in length wherein W is the width of a vertical block wall section to be formed. Any suitable means, such as motor 23 shown schematically in FIG. 1, may be provided for power in the first conveyor belt system 10.

The second conveyor belt system 11 includes the second conveyor belt 12, and may be powered by any suitable means such as motor 25 indicated schematically in FIG. 1. As shown most clearly in FIGS. 5–7, the rails 17 are disposed on either side of the conveyor belt 12, and are adpated to cooperate with track engaging wheels 27 of the movable pallet 14. The track forming a third conveying system 13 includes rails that are merely an extension of the rails 17. The second conveyor belt system 11 is disposed as a continuation of the first conveyor belt system 10, and the upper transporting surface B of belt 12 is normally disposed at the horizontal level L, and is at least W in length. The track of the third conveying system 13 is also generally horizontal, and is disposed as a continuation of the second conveying belt system 11, and is also disposed at level L. The wheeled pallet 14 is also at least W in length.

The means 18 for vertically moving the second conveyor belt system 11 is capable of moving the second conveyor belt system 11 so that a row R of blocks disposed thereon may be elevated at least a vertical distance D (see FIGS. 1 and 6) great enough to allow the pallet 14 to be disposed in cooperation with the track means 16 and beneath a row of blocks when the row of blocks is held in the vertical position (distance D) to which it may be elevated. The means 18 includes a vertically upstanding guide member 30, a mounting plate arrangement 32 for mounting the second conveyor belt and the track means rails 17, guide means 34 associated with the mounting plate 32 for cooperating with the guide member 30 to provide vertically guided movement of the second conveyor belt 12 and hydraulic ram means 36 operatively connected to the mounting plate 32. Preferably, at least two hydraulic rams 36 are provided, one at either end of the mounting plates 32. Each ram 36 has a stroke at least of distance D (see FIG. 6).

Figure 5:
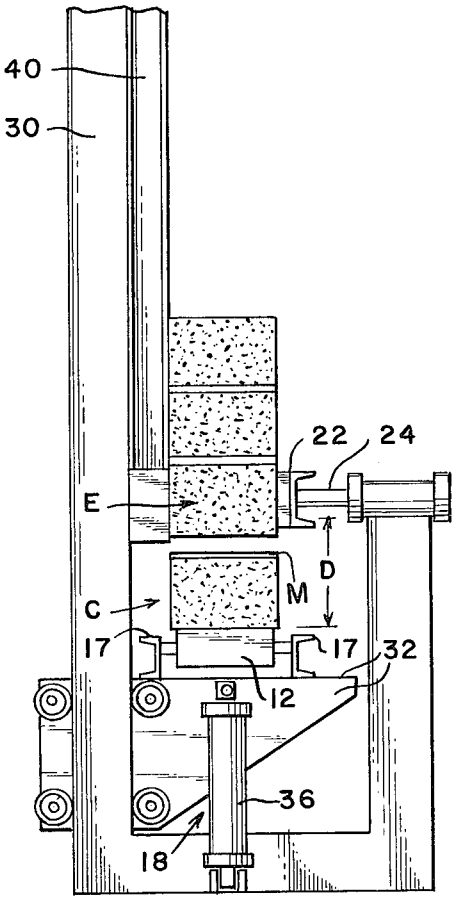
FIG. 5 is a side view taken along lines 5—5 of FIG. 1 showing exemplary apparatus according to the present invention in detail when the method step illustrated in FIG. 1 is being practiced.

The holding means 20 may comprise an elongated clamp plate 22 mounted at a fixed vertical position a vertical distance (D) above the normal position of the second conveyor belt 12 at least as great as the height of the pallet 14, a plurality of horizontally extendable hydraulic ram means 24 (one of which is shown in FIGS. 5–7) mounting the clamping plate 22, and a stationary bearing ledge 26 disposed at substantially the same vertical position as the clamping plate 22 on the opposite of the second conveyor belt 12 from the clamping plate 22. In order to insure stability of the vertical wall section being formed, a vertically upstanding block guide member 40 may be provided adapted to abut blocks being formed into the wall section, the member 40 being disposed on the same side of the second conveyor belt 12 as the bearing ledge 26, and providing a substantially vertical continuation of the bearing ledge 26.

According to the method of the present invention, a first row of blocks of width W is transported from the first conveyor belt 22 to the second conveyor belt 12, and the second conveyor belt 12 is elevated by means 18, a distance D at least as great as the height of the blocks of the second row of blocks, and the elevated first row of blocks is held by means 20 in the position to which it has been elevated while the second conveyor belt 12 is lowered to receive the second row of blocks. The second row of blocks having mortar M (see FIG. 5) disposed on the upper surface thereof and of width W is transported from the first conveyor belt 22 to the second conveyor belt 12 so that the second row of blocks is disposed immediately under the first row of blocks, the conveyor belt 12 is elevated by means 18 until contact is made between the mortar M on the top of the second row of blocks and the first row of blocks, and the hold by means 20 on the first row of blocks is released when contact is made with the mortar of the second row of blocks, and the elevation of the second conveyor belt 12 the distance D (at least as great as the height of blocks of a third row of blocks) is continued. The elevated first and second rows of blocks are held by means 20 into the position into which they have been elevated while the second conveyor belt 12 is lowered to receive a third row of blocks and then the above steps are repeated for a third and subsequent rows of blocks until a vertical wall section of a desired predetermined height is formed. This will be particularly described — with respect to the drawings — for the fourth row of blocks C. As shown in FIGS. 1 and 5, the third row of blocks E is held by clamping means 20 a distance D above the second conveyor belt 12 under the blocks of row E, the row of blocks C being transported from the first conveyor system 10 to the second conveyor system 12. When the blocks of row C are disposed immediately under the third row of blocks E, the operation of the conveyor belt 12 is stopped, and the means 18 raise the conveyor belt 12 so that the mortar M is moved into contact with the blocks of row E until the desired joint thickness is achieved. The holding means 20 are then released, and elevation of the row C is continued to the position shown in FIGS. 2 and 6. After the row C is elevated to the position shown in FIGS. 2 and 6 the clamping means 20 is again actuated, and the row C is held in the elevated position while the second conveyor system 11 is once again lowered to receive another row, R, of bricks. (It is noted that throughout the specification and claims the terms "blocks" is to be interpreted to means conventional bricks, blocks and like structures for forming a wall.)

After a wall of the predetermined desired height is formed — as shown in FIGS. 3 and 7 — with the lower most row F of blocks held by the clamping means 20, the second conveyor system 11 is lowered to level L, the pallet 14 is moved onto the track means 16 associated with the second conveyor system 11, the second conveyor system 11 with the pallet 14 disposed thereon is elevated by the means 18 until the pallet comes into contact with the row F of the wall section, and the clamping means 20 are released as the second conveyor means 11 with pallet 14 disposed thereon is gradually lowered (as shown in FIGS. 3 and 7). Once the pallet 14 is again at level L, the wall section is transported on the pallet to a position horizontally removed from the second conveyor belt system 11 (as shown in FIG. 4), in a direction away from the first conveyor system 10. There is no need to wait until the mortar sets in the wall section before horizontally moving the wall section away from the second conveyor system 11, but rather this may be accomplished as soon as the wall section of predetermined desired height is completed. As soon as the pallet 14 is removed from the second conveyor system 11, the second conveyor belt 12 is ready to accept another row of blocks thereon for the formation of another wall section.

Preferably, each row of blocks is transported from the first conveyor belt 22 to the second conveyor belt 12 as a unit (as shown in the drawings), all the blocks of each row already mortared together during transport thereof. In this way, there is no time lag as individual blocks are assembled into a row R and pushed onto the second conveyor. Completed rows R from a plurality of row assembling structures may be fed to the first conveyor belt system 10, or the rows R may be formed on the conveyor belt 22 during the elevating and lowering steps of the second conveyor system 11 so that a complete row can be formed and fed onto the second conveyor system 11 without any significant time lag.

It will thus be seen that according to the present invention an improved method and apparatus have been provided for the fabrication of a vertical wall section, the chances of damage to blocks by the fabrication apparatus being minimized as compared to the prior art, and the fabrication of the wall section is substantially continuous, no time lag occasioned by the feeding of individual blocks to the elevating conveyor system and no time lag occasioned by waiting for the mortar to set after wall section fabrication in order to transport the wall section being provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for fabricating a vertical block wall section having a width W, comprising (a) a first conveyor belt system, said first conveyor belt system having an upper transporting surface thereof that is generally horizontal and at a horizontal level L, and at least W in length, (b) a second conveyor belt system disposed as a continuation of said first conveyor belt system and having an upper transporting surface thereof that is generally horizontal and is normally disposed at the horizontal level L, and is at least W in length, (c) a third conveying system disposed as a linear continuation of said second conveyor belt system, said third conveying system including a track that is generally horizontal and at a horizontal level L, (d) a wheeled pallet disposed on said track and movable with respect thereto and at least W in length, (e) track means formed with said second conveyor belt system, said track means including two separate track rails, one disposed on either side of the conveyor belt of said second conveyor belt system and so disposed with respect to said second conveyor belt system that when said pallet cooperates with said track means said pallet is disposed above the upper transporting surface of said second conveyor belt, (f) means for vertically moving said second conveyor belt system so that a row of blocks disposed thereon may be elevated at least a vertical distance great enough to allow said pallet to be disposed in cooperation with said track means and beneath a row of blocks when the row of blocks is in the vertical position to which it may be elevated, and (g) means for selectively holding rows of blocks in an elevated position to which they are movable by said vertically moving means.

2. Apparatus as receited in claim 1, wherein said second conveyor belt system vertically moving means includes a vertically upstanding guide member, a mounting plate for mounting said second conveyor belt and said track means rails, guide means associated with said mounting plate for cooperating with said guide member to provide vertically guided movement of said second conveyor belt, and hydraulic ram means operatively connected to said mounting plate.

3. Apparatus as receited in claim 1, wherein said holding means comprises a horizontally elongated clamp plate mounted at a fixed vertical position a vertical distance above the normal position of said second conveyor belt system at least as great as the height of said pallet, a plurality of horizontally extendable hydraulic ram means mounting said clamping plate, and a stationary bearing ledge disposed at substantially the same vertical position as said clamping plate on the opposite side of said second conveyor belt from said clamping plate.

4. Apparatus as recited in claim 3, further comprising a stationary vertically upstanding block guide member disposed on the same side of said second conveyor belt as said bearing ledge and providing a substantially vertical continuation of said bearing ledge.

5. Apparatus as recited in claim 1, further comprising a stationary vertically upstanding block guide member adapted to abut blocks being formed into a wall section and to assist in preventing excessive horizontal movement thereof.

6. A method for fabricating a vertical block wall section, having a width W, from rows of blocks and utilizing first and second conveyor belts and a movable pallet, said method comprising the steps of (a) transporting a first row of blocks of width W from the first conveyor belt to the second conveyor belt, (b) elevating the second conveyor belt and the first row of bricks thereon a distance at least as great as the height of the blocks of a second row of blocks, (c) holding the elevated first row of blocks in the position to which it has been elevated while lowering the second conveyor belt to receive a second row of blocks, (d) transporting a second row of blocks, having mortar disposed on the upper surface thereof, and of width W, from the first conveyor belt to the second conveyor belt so that the second row is disposed immediately under the first row of blocks, (e) elevating the second conveyor belt and the second row of blocks thereon so that contact is made between the mortar on the top of the second row of blocks and the first row of blocks, (f) releasing hold of the first row of blocks after contact is made with the mortar of the second row of blocks, and continuing elevation of the second conveyor belt a distance at least as great as the height of blocks of a third row of blocks, (h) repeating steps (d) – (g) for third and subsequent rows of blocks until a vertical wall section of a desired predetermined height is formed, (i) holding the vertical wall section of desired predetermined height in an elevated position at least as great as the height of the movable pallet, while lowering the second conveyor belt out of contact therewith, (j) horizontally moving the movable pallet to a position directly under the vertical wall section of desired predetermined height, (k) elevating the pallet until it is in contact with the wall section, (l) releasing hold of the elevated wall section, (m) lowering the pallet with wall section disposed thereon, (n) transporting the wall section on said pallet to a position horizontally removed from the second conveyor belt, and (o) wherein steps (j) – (n) are accomplished substantially immediately after formation of the vertical wall section of desired predetermined height without any necessary time lag for drying of the mortar holding the rows together to form the wall section being necessary.

7. A method as recited in claim 6, wherein said pallet is mounted on wheels and is movable on a track, the track including portions on said second conveyor, said method step of horizontally moving the pallet to a position directly under the vertical wall section being accomplished by rolling said pallet on said track means over said second conveyor belt and beneath said wall section.

8. A method as recited in claim 6, wherein each row of blocks is transported from the first conveyor belt to the second conveyor belt as a unit, all the blocks of each row already mortared together while being transported from the first conveyor belt to the second conveyor belt, assembling of said blocks unit taking place at the same time, but in a different position, as step (d).

9. A method as recited in claim 6, wherein said step of transporting the wall section of the pallet to a position horizontally removed from the second conveyor system is accomplished by moving the wall section on the pallet in a horizontal direction away from the first conveyor belt.

10. A method as recited in claim 6 wherein the holding of a row of blocks is maintained and elevating of the second conveyor belt with another row of blocks thereon is continued, until the mortar between the blocks is compressed and the desired joint thickness is achieved, and only after the desired joint thickness is achieved is the hold released.

* * * * *